United States Patent [19]

Latimer

[11] Patent Number: 5,060,475

[45] Date of Patent: Oct. 29, 1991

[54] PILOT CONTROL CIRCUIT FOR LOAD SENSING HYDRAULIC SYSTEMS

[75] Inventor: Eugene E. Latimer, Wilmington, Ill.

[73] Assignee: Caterpillar Inc., Peoria, Ill.

[21] Appl. No.: 530,147

[22] Filed: May 29, 1990

[51] Int. Cl.[5] ..... F15B 11/08

[52] U.S. Cl. ..... 60/413; 91/461

[58] Field of Search ..... 91/461, 304, 529; 60/452, 413, 450

[56] References Cited

U.S. PATENT DOCUMENTS

| | | | |
|---|---|---|---|
| 2,392,471 | 1/1946 | Fox . | |
| 4,204,461 | 5/1980 | Gratzmuller | 91/461 X |
| 4,362,089 | 12/1982 | Melocik et al. | 91/461 |
| 4,381,904 | 5/1983 | Kyte et al. | 417/287 |
| 4,635,440 | 1/1987 | Kropp | 60/422 |
| 4,813,235 | 3/1989 | Miller | 60/452 |
| 4,850,191 | 7/1989 | Kreth et al. | 60/452 X |
| 4,976,106 | 12/1990 | Noerskau et al. | 60/452 |

FOREIGN PATENT DOCUMENTS

| | | | |
|---|---|---|---|
| 2536126 | 2/1976 | Fed. Rep. of Germany . | |
| 2098423 | 3/1972 | France . | |
| 24213 | 2/1980 | Japan | 91/461 |
| 168903 | 2/1985 | Japan . | |

*Primary Examiner*—John T. Kwon
*Assistant Examiner*—George Kapsalas
*Attorney, Agent, or Firm*—John W. Grant

[57] ABSTRACT

Pilot control circuits are useful, for example, for controlling the actuation of main control valves of load sensing hydraulic systems. Using the main supply pump as the source of pressurized pilot fluid sometimes results in inadequate pilot pressure for maintaining the main control valves in an actuated position under some operating conditions. The subject pilot control system includes an accumulator to store pressurized fluid received from the main supply pump for use by the pilot control circuit when the pressure level of the main hydraulic system momentarily drops below a level for proper pilot control operation. Thus, the main control valves are maintained in their actuated position irregardless of the pressure level of the fluid in the main supply system.

2 Claims, 1 Drawing Sheet

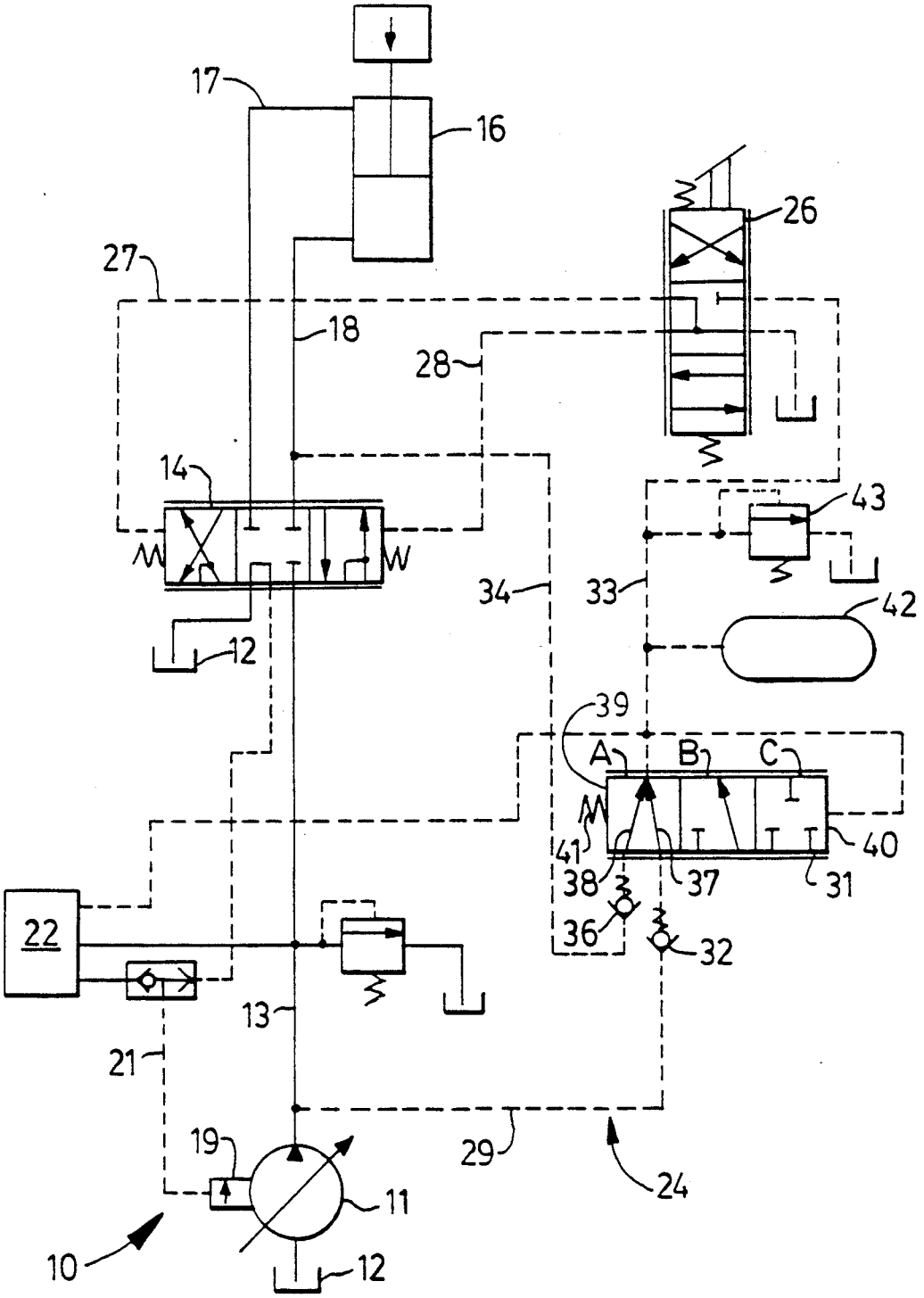
17
16
26
27
18
28
14
43
34
33
42
12
39
A
B
C
41
40
38
37
31
36
32
22
13
21
19
29
24
11
10
12

PILOT CONTROL CIRCUIT FOR LOAD SENSING HYDRAULIC SYSTEMS

BACKGROUND OF THE INVENTION

1. Field of the Invention

This invention relates generally to a load sensing hydraulic system and more particularly to a pilot control circuit incorporated within the load sensing system.

2. Description of the Prior Art

The load sensing variable displacement pump of a load sensing hydraulic system usually has a pressure responsive displacement controller which automatically adjusts pump output to meet flow and pressure demands of the system. If none of the hydraulic motors of the hydraulic systems are being operated in a manner to generate a load pressure signal for transmission to the displacement controller, the output of the pump is reduced to a minimum level sufficient to maintain the system pressure at a relatively low margin pressure. The hydraulic motors of many such load sensing systems are controlled by a pilot operated control valve which is moved to an operating position by directing pressurized pilot fluid to the appropriate end of the control valve through a manually operated pilot control valve. Since the margin pressure is normally 30 at a sufficient level to support pilot actuation of the pilot operated control valves, the pilot circuit of some of those systems utilize the load sensing variable displacement pump as a source of pressurized pilot fluid. To prevent over-pressurization of the pilot system, a pressure reducing valve is commonly provided in the pilot circuit to maintain the pressure of the pilot circuit at a level slightly less than the margin pressure of the main system.

One of the problems encountered with such systems occurs when a pilot operated directional control valve is moved to a position sufficient to allow a load supported by a hydraulic motor to freefall such that the side of the motor receiving fluid from the directional control valve tends to cavitate. During a freefall condition, the flow requirements to fill the expanding or intake side of the motor is usually greater than the output capacity of the pump even though the pump strokes to its maximum displacement setting. Thus the intake side of the motor tends to cavitate and since the main supply conduit from the pump is connected with the cavitated side of the motor through the control valve, the main system pressure drops below the pressure level of the pilot circuit. Consequently, the pressure level of the pilot circuit drops allowing the control valve to move back to its neutral position prematurely stopping the lowering of the load.

The present invention is directed to overcoming one or more of the above problems.

SUMMARY OF THE INVENTION

In one aspect of the present invention, a pilot control circuit is provided for a load sensing hydraulic system which has a hydraulic motor, a load sensing variable displacement pump, a supply conduit connected to the pump, and a pilot operated valve connected to the supply conduit and to the hydraulic motor and being moveable to a position at which the supply conduit communicates with the motor. The pilot control circuit comprises a pilot control valve connected to the pilot operated valve, a primary pilot line connected to the supply conduit, a secondary pilot line connected to the pilot control valve, a pressure reducing valve connected to the primary and secondary pilot lines and adapted to reduce the pressure of the fluid passing therethrough from the primary pilot line to the secondary pilot line to a predetermined level and accumulator means connected to the secondary pilot line for storing pressurized pilot fluid for use by the pilot control circuit to maintain the pilot operated valve in the operating position when the fluid pressure level in the supply conduit momentarily drops to a level lower than said predetermined level.

The present invention provides a pilot control circuit which is connected to a main supply conduit of a load sensing hydraulic system through a reducing valve and thereby utilizes the load sensing variable displacement pump as the source of pressurized pilot fluid. The pilot circuit includes an accumulator connected to a pilot line downstream of the pressure reducing valve for storing fluid which can be used for the pilot circuit under conditions wherein the pressure in the main supply conduit is momentarily insufficient to maintain the pilot operated valve in an actuated condition.

BRIEF DESCRIPTION OF THE DRAWINGS

The sole FIGURE is a schematic illustration of an embodiment of the present invention.

DETAILED DESCRIPTION OF THE PREFERRED EMBODIMENT

A load sensing hydraulic system 10 includes a load sensing variable displacement pump 11 connected to a tank 12, a supply conduit 13 connected to the pump, a pilot operated directional control valve 14 connected to the supply conduit 13 and to the tank 12, and a load supporting hydraulic motor 16 connected to the directional control valve 14 through a pair of motor conduits 17,18. The pump 11 has a displacement controller 19 for automatically adjusting the pump output to meet the flow and pressure demands of the system. A load pressure signal network 21 is connected to the displacement controller 19 and to the directional control valve 14. Another work system 22 is connected to the supply conduit 13 and to the signal network 21 in the usual manner.

A pilot control circuit 24 includes a manually actuated pilot control valve 26 connected to opposite ends of the directional control valve 14 through a pair of pilot lines 27,28. A primary pilot line 29 is connected to the supply conduit 13 and to a combined selector and pressure reducing valve 31 through a check valve 32. A secondary pilot line 33 connects the pressure reducing valve 31 to both the pilot control valve 26 and the work system 22. A load pressure pilot line 34 is connected to the motor line 18 and to the pressure reducing valve 31 through a check valve 36. The pressure reducing valve 31 has primary and secondary flow paths 37,38 therethrough and opposite ends 39,40 and is urged to the position shown by a spring 41 disposed at the end 39. The secondary pilot line 33 is connected to the end 40. 30 An accumulator 42 and a relief valve 43 are connected to the secondary pilot line downstream from the pressure reducing valve.

The pressure reducing valve 31 is moveable between three basic infinitely variable ranges of operating positions indicated by the letters A, B, and C. At the A position of the reducing valve, the primary and secondary flow paths 37,38 are both in communication with the pilot line 33. At the B position, the primary flow path 37 is in communication with the pilot line 33 and the secondary flow path 38 is blocked therefrom. At the C position of the reducing valve, the primary and secondary flow paths 37,38 are both blocked from the pilot line 33.

INDUSTRIAL APPLICABILITY

The directional control valve 14 is moveable from the neutral position shown to first and second infinitely variable operating positions. At the neutral position, the supply conduit 13 and motor lines 17,18 are isolated from each other, while the signal network 21 is vented to the tank 12. Rightward movement of the directional control valve 14 to the first operating position communicates the motor conduit 17 with the supply conduit 13 and the signal network 21 while the motor conduit 18 is communicated with the tank 12. Similarly, leftward movement of the directional control valve to the second operating position communicates the motor conduit 18 with the supply conduit 13 and the signal network 21 while the motor conduit 17 is communicated with the tank 12. When the directional control valve 14 is in the neutral position shown, no load pressure signal is being directed to the displacement controller 19 and the displacement of the pump automatically adjusts to 30 a position to maintain a substantially low margin pressure in the supply conduit 13. In this embodiment, the margin pressure is approximately 2000 kPa.

The pressurized fluid in the supply conduit 13 passes through the pilot line 29, the check valve 32, the primary flow path 37 of the pressure reducing valve 31 and into the pilot line 33. The pressurized fluid in the pilot line 33 exerts a force on the end 40 of the pressure reducing valve 31 moving it leftwardly against the spring 39 generally to the B position. More specifically, the reducing valve will oscillate somewhat between the B and C positions to controllably modulate or meter fluid flow through the primary flow path 37 to reduce the pressure of the fluid passing therethrough to the pilot line 33 to a predetermined pressure level which in this embodiment is about 1800 kPa. Pressurized fluid in the pilot line 33 enters the accumulator 42 and is stored therein at the 1800 kPa level.

To extend the hydraulic motor 16, the operator moves the pilot control valve 26 downwardly to direct pressurized fluid from the pilot line 33 through the pilot line 28 moving the pilot operated directional control valve 14 leftwardly to the second operating position. At such position, pressurized fluid in the supply conduit 13 passes through the directional control valve and motor conduit 18 to the hydraulic motor 16. The load pressure in the motor line 18 is transmitted through the directional control valve and the signal network 21 to the displacement controller 19 to change the displacement of the pump 11 to generate sufficient fluid flow and pressure to meet the demand required to extend the hydraulic motor 16.

To retract the hydraulic motor 16, the operator moves the pilot control valve 26 upwardly to direct pressurized pilot fluid from the pilot line 33 through the pilot line 27 moving the directional control valve 14 rightwardly to its first operating position. If the control valve 14 is moved sufficiently rightwardly, the load supported by the hydraulic motor 16 tends to freefall. When this happens, the expanding side of the hydraulic motor tends to cavitate and momentarily causes a drastic reduction in the fluid pressure in the motor conduit 17 and the supply conduit 13 to a pressure level lower than the predetermined pressure level of the fluid in the secondary pilot line 33 even though the displacement controller 19 causes the pump to go to its maximum displacement setting in an attempt to maintain the output pressure at the minimum margin pressure. Under this condition, the check valve 32 prevents reverse flow of pilot fluid through the primary pilot line 29 such that the pressurized fluid stored in the accumulator 42 becomes available for use by the pilot control circuit 10 to maintain the directional control valve 14 in its actuated position. The pressurized fluid from the accumulator is also available for use by the pilot control of the work system 22.

The capacity and the pressure rating of the accumulator is chosen to provide a sufficient supply of pilot fluid at a pressure level to maintain the directional control valve 14 in its actuated position during the period of time that the pressure level in the supply conduit 13 is momentarily lower than the pressure level in the pilot line 33. In this embodiment such period of time is about the amount of time that the hydraulic motor is in the freefall condition.

The load pressure pilot line 34 provides a backup supply of pressurized fluid to the pilot circuit 24 in situations where the pump is not operating. Under that condition, the load generated pressure in the motor conduit 18 can pass through the load pressure pilot line 34, the check valve 36, and the secondary flow path 38 of the pressure reducing valve and into the pilot line 33 where it acts on the end 40 of the pressure reducing valve. The pressure reducing valve will remain basically in the A position, but will oscillate somewhat between the A and B positions to controllably meter the fluid flow through the secondary flow path to reduce the pressure of the fluid passing through the secondary flow path similarly to that described above. The fluid passing through the pressure reducing valve under this condition can thus be utilized by the pilot control valve 26 to move the directional control valve rightwardly to connect the motor conduit 18 to the reservoir 12 for lowering the load. Although the primary flow path remains in communication with the pilot line 33, reverse flow therethrough is blocked by the check valve 32.

In view of the foregoing, it is readily apparent that the structure of the present invention provides an improved pilot control circuit for a load sensing hydraulic system wherein the control valves are maintained in an actuated position even though the main system pressure momentarily drops below a level sufficient to support pilot operation. This is accomplished by connecting an accumulator to the pilot line for storing pressurized fluid which can then be used to maintain a pilot operated control valve in an actuated condition regardless of the pressure level existing in the main system. Moreover, the pilot control circuit is also connected in a manner that enables it to use load generated pressure as the source of pilot pressure for lowering a load even when the main system pump is not operating.

Other aspects, objects, and advantages of this invention can be obtained from a study of the drawing, the disclosure, and the appended claims.

I claim:

1. A pilot control circuit for a load sensing hydraulic system having a hydraulic motor, a load sensing variable displacement pump, a supply conduit connected to the pump, and a pilot operated valve connected to the supply conduit and to the hydraulic motor and being moveable to an operating position at which the supply conduit communicates with the hydraulic motor, comprising:

a pilot control valve connected to the pilot operated valve;

a primary pilot line connected to the supply conduit;

a secondary pilot line connected to the pilot control valve;

a load pressure line connected to the load supporting end of the hydraulic motor;

a pressure reducing valve connected to the primary, secondary, and load pressure pilot lines and having primary and secondary flow paths therethrough, the pressure reducing valve being movable between a position at which fluid flow through the primary flow path between the primary and secondary pilot lines is controllably metered and fluid flow through the secondary flow path is blocked, and another position at which fluid flow through the secondary flow path between the load pressure pilot line and the secondary pilot line is controllably metered, the reducing valve being adapted to reduce the pressure of the fluid passing therethrough from the primary and load pressure pilot lines to the secondary pilot line to a predetermined level; and accumulator means connected to the secondary pilot line downstream from the pressure reducing valve for storing pressurized pilot fluid for use by the pilot control circuit to maintain the pilot operated valve in the operating position when the fluid pressure level in the supply conduit momentarily drops to a level lower than said predetermined level.

2. The pilot control system of claim 1, including a check valve disposed in the load pressure pilot line.

* * * * *